US006237996B1

(12) United States Patent
Chen et al.

(10) Patent No.: US 6,237,996 B1
(45) Date of Patent: May 29, 2001

(54) DETACHABLE SEAT

(75) Inventors: Er-Jui Chen, Feng-Shan; Ling-Chuan Chang, Chia-I; Cheng-Fan Yang, Tainan Hsien, all of (TW)

(73) Assignee: Link Treasure Limited (VG)

( * ) Notice: Subject to any disclaimer, the term of this patent is extended or adjusted under 35 U.S.C. 154(b) by 0 days.

(21) Appl. No.: 09/642,213

(22) Filed: Aug. 17, 2000

(51) Int. Cl.[7] ..... A47C 13/00

(52) U.S. Cl. ..... 297/130; 297/423.4

(58) Field of Search ..... 297/118, 130, 297/250.11, 256.1, 423.1, 423.2, 256.16, 423.21, 354.12, 423.4, 423.19, 423.26, 423.28, 440.1

(56) References Cited

U.S. PATENT DOCUMENTS

| | | | |
|---|---|---|---|
| 505,083 | * | 9/1893 | Ausman . |
| 2,484,803 | * | 10/1949 | Bell et al. . |
| 2,881,824 | * | 4/1959 | Herrmann . |
| 4,786,064 | * | 11/1988 | Baghdasarian . |
| 5,335,968 | * | 8/1994 | Sheridan et al. . |
| 6,074,007 | * | 6/2000 | Helmsderfer et al. . |

* cited by examiner

*Primary Examiner*—Milton Nelson, Jr.
(74) *Attorney, Agent, or Firm*—W. Wayne Liauh

(57) ABSTRACT

A detachable seat comprises a movable curve member capable of being in a first position when curve member is extended away from the seat to serve as footrest or a second position when curve member is beneath seat such that curve member and seat together are supported on the ground to serve as an independent chair.

12 Claims, 4 Drawing Sheets

DETACHABLE SEAT

BACKGROUND OF THE INVENTION

1. Field of Invention

The present invention relates to a seat mounted on highchair, stroller, or swing capable of being detached therefrom to serve as an independent chair.

2. Related Art

Conventionally, a seat is provided on highchair, stroller, or swing for providing some degree of comfort to infant seated thereon. Typically, a footrest either detachable or fixed is coupled to the seat. In detail, as for fixed seat two tubes or a plate thereof are (or is) threadedly secured to front legs, or alternatively the footrest being integrally formed with seat. Also, a seat may be detached from highchair, stroller or swing to serve as seat on automobile. However, such detached seat may not serve as an independent chair to stand on a supporting ground. For example, U.S. Pat. No. 5,951,102 discloses a chair comprising a seat having a seat portion and a back portion, a seat support, and a frame having a plurality of front legs, rear legs, and hinges. It also discloses following components. For example, two elongate projections inserted into holes in the rear of seat, a hook on the front underside of seat, a wing plate beneath either arm, and rotational means. Seat support for supporting seat comprises second hinges and rectangular tubes having bends near legs and coupled to second hinges on the front. The hook is hooked on tube. The second hinge is abutted on the front edge of the wing plate. The rotational means is provided on second hinge to rotate. The hinge of frame is pivotably coupled to the ends of front and rear legs. The second hinge of seat support is pivotably coupled to front leg. Seat support is movable along front leg by pressing the rotational means.

But above patent is unsatisfactory for the purpose for which the invention is concerned because seat can not stand on ground on its own after being detached from seat support.

SUMMARY OF THE INVENTION

It is therefore an object of the present invention to provide a detachable seat comprising a movable curve member capable of being in a first position when curve member is extended away from the seat to serve as footrest or a second position when curve member is beneath seat such that curve member and seat together are supported on the ground to serve as an independent chair.

The advantages of the present invention are realized by providing a detachable seat wherein in the first position, wing plate is snapped in apertures of the curve member passing through the rectangular opening in the front lower portion of seat, and curve member is restrained from pivoting counterclockwise any further when infant's feet are placed on footrest of the curve member since the pivot of the curve member is restrained by pin, thereby securing the curve member; and in the second position, footrest of the curve member is received in the rectangular opening of the seat, and engagement portion of curve member is engaged with the triangular wing plate beneath the seat such that the seat is stably supported on the ground.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become fully understood from the detailed description given hereinbelow illustration only, and thus are not limitative of the present invention, and wherein.

DETAILED DESCRIPTION OF THE INVENTION

Figure 1:
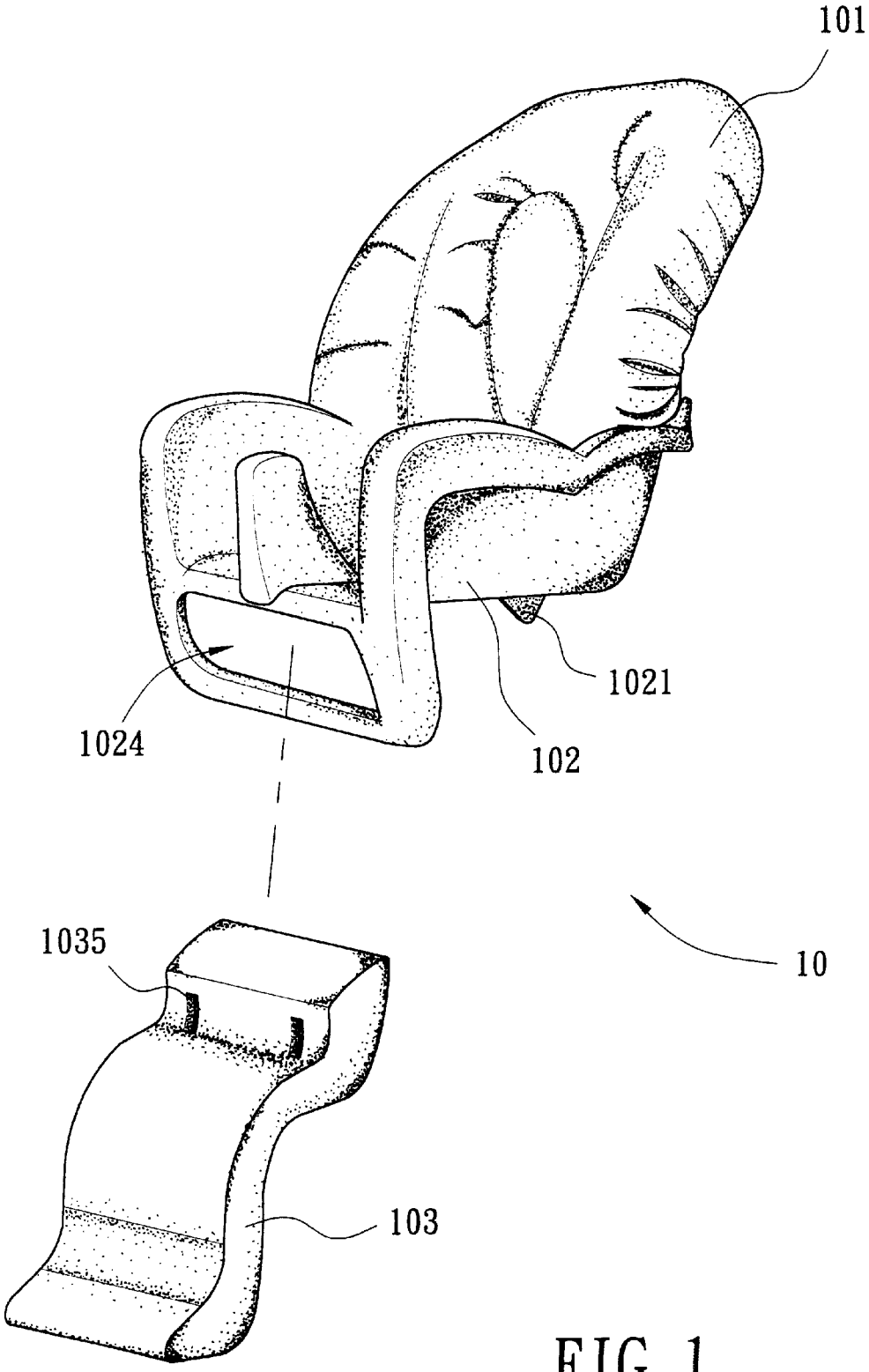
FIG. 1 is a perspective view of a detachable seat according to the invention wherein curve member is separated from seat.
Figure 2:
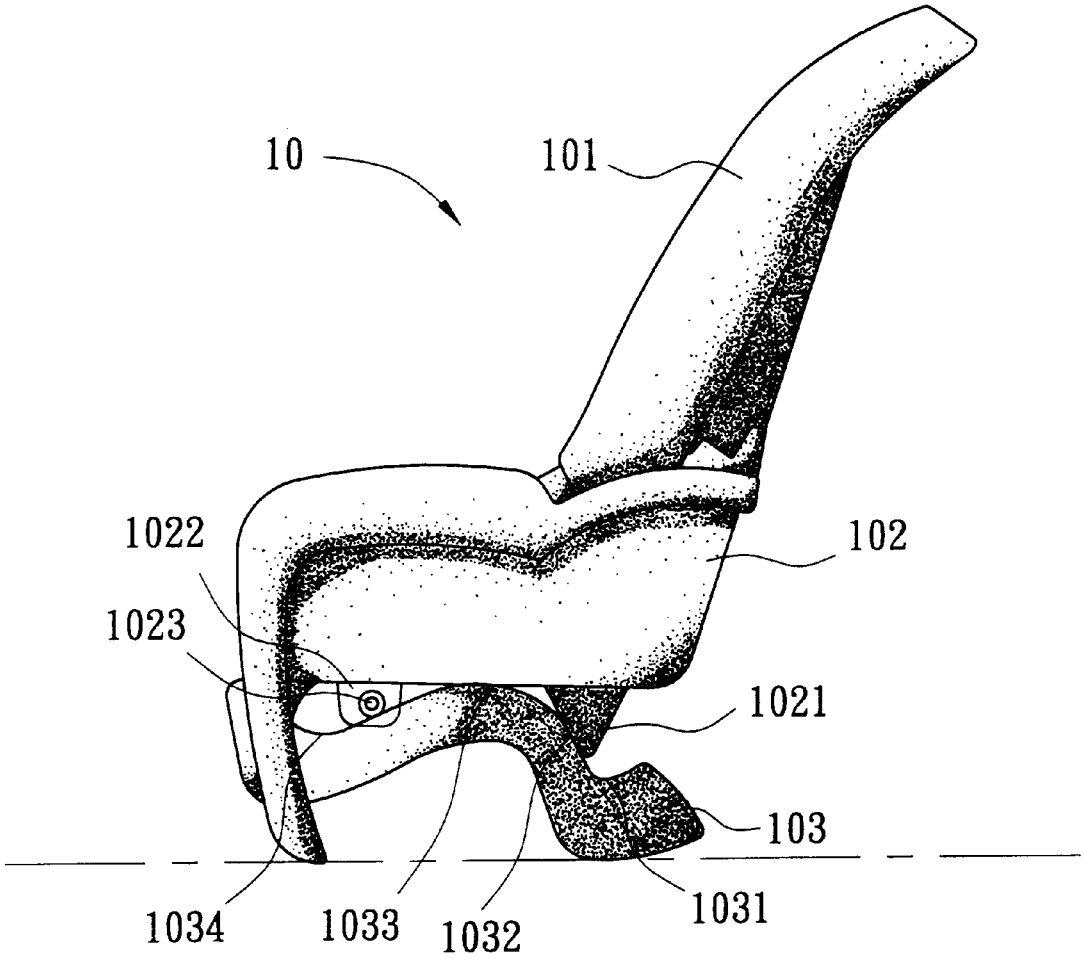
FIG. 2 is a side view of the FIG. 1 seat with curve member disposed under the curve member in a second position.
Figure 3:
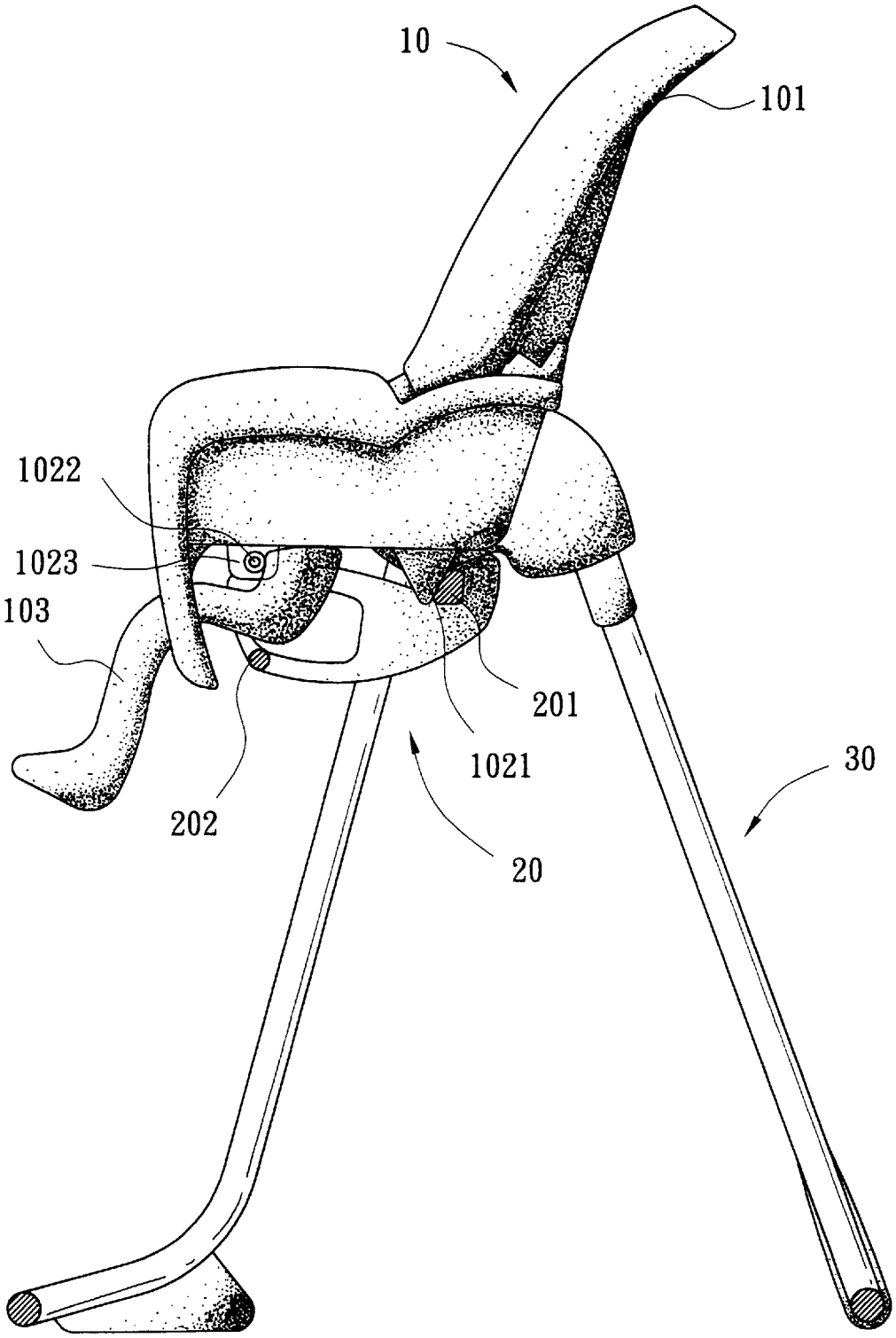
FIG. 3 is a side view of the FIG. 1 seat mounted on highchair with curve member extended to serve as footrest in a first position.

Referring to FIGS. 1, 2, and 3, there is shown a seat 10 constructed in accordance with the invention comprising a back portion 101, a seat portion 102, and a curve member 103. Back portion 101 is pivotably secured to seat portion 102. A triangular wing plate 1021 is centrally disposed under the bottom of seat portion 102. An elongate wing plate 1022 is in the front of wing plate 1021 having a bore for permitting pin 1023 to pass through. A rectangular opening 1024 is provided in the front lower portion of seat portion 102 for permitting curve member 103 to insert through to be located in a first position (i.e., most of curve member 103 extended away from the seat portion 102) or a second position (i.e., near all of curve member 103 beneath seat portion 102). Curve member 103 comprises a bend 1031, an engagement portion 1032, a top portion 1033, a footrest 1034, and a pair of apertures 1035.

In the first position (FIG. 3), wing plate 1022 is snapped in apertures 1035. At this position, curve member 103 is restrained from pivoting counterclockwise any further when infant's feet are placed on the recess shaped footrest 1034 since the pivot of curve member 103 is restrained by pin 1023. As a result, curve member 103 is secure.

In the second position (FIG. 2), footrest 1034 is received in opening 1024 of seat portion 102. Engagement portion 1032 of curve member 103 is engaged with the front edge of wing plate 1021. Fop portion 1033 is urged against the underside of seat portion 102. The bottom of bend 1031 and the front lower edge of seat portion 102 are supported on ground. As a result, the seat 10 can serve as an independent chair.

Figure 4:
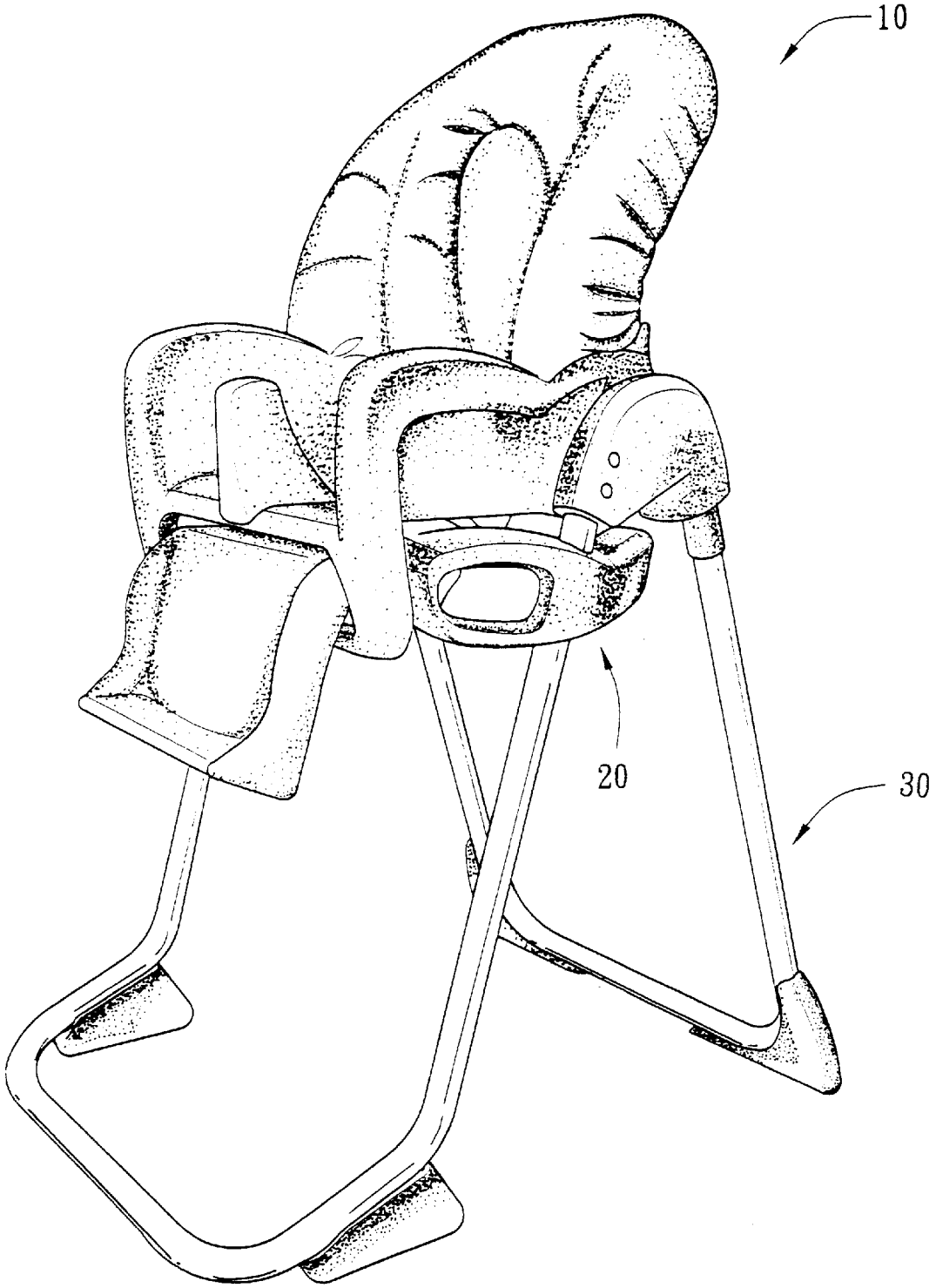
FIG. 4 is a perspective view of FIG. 3.

Referring to FIGS. 3 and 4, there is shown a seat 10 of the invention mounted on shaped hollow member 20 and support structure 30 of highchair. Seat 10 is for supporting infant. Shaped hollow member 20 comprises a front portion 202 and a rear portion 201 functioning as supporting seat 10 and infant. Support structure 30 functions as supporting the whole support and infant.

In a first position, seat 10 is supported by shaped hollow member 20 with rear portion 201 engaged with wing plate 1021, front portion 202 beneath the bend 1031 of curve member 103 when curve member 103 is extended away from the seat 10 for supporting curve member 103.

In a second position, curve member 103 is pushed inward to a position beneath seat 10 and below footrest 1034 of curve member 103. At this time, rear 201 is engaged with the top of bend 1031 of curve member 103.

Note that the detachable seat of the invention is also applicable to stroller or swing in addition to above highchair case.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A convertible seat device comprising:

a seat having an opening in a front lower portion and a plurality of elongate wing plates; and a curve member including a bend, a top portion, a footrest, and a plurality of apertures, the curve member being movably disposed in the opening of the seat being in a first position when the curve member is extended away from the seat with the elongate wing plates snapped in the apertures of the curve member passing through the opening or a second position when the curve member is beneath the seat with the footrest received in the opening and the top portion urged against the underside of the seat such that the curve member and the seat together are supported on the ground.

2. The convertible seat device of claim 1, wherein the seat further comprising a plurality of triangular wing plates disposed under the bottom of the seat, and the curve member further comprises an engagement portion engaged with the edges of the triangular wing plates in the second position.

3. The convertible seat device of claim 1, wherein the seat further comprises a back portion and a seat portion pivotably secured to the back portion.

4. The convertible seat device of claim 1, wherein the curve member comprises a recess shaped footrest.

5. The convertible seat device of claim 1, wherein the elongate wing plates are in the front portion beneath the seat each having a bore, and further comprising a pin passed through the bores for withstanding force applied by the curve member.

6. An infant support, comprising:

a support structure;

a seat releasably secured to the supporting structure in an elevated position, the seat having an opening in a front lower portion of the seat; and a curve member movably disposed in the opening of the seat, the curve member being structured such that it is either in a first position when the curve member is extended away from the seat to serve as a footrest, or in a second position when the curve member is beneath the seat such that the curve member and the seat together are supported on the ground.

7. The infant support of claim 6, wherein the seat further comprises a back portion and a seat portion pivotably secured to the back portion.

8. The infant support of claim 6, wherein the curve member comprises a recess shaped footrest.

9. The infant support of claim 6, wherein the infant support is a highchair.

10. The infant support of claim 6, wherein the seat further comprises a plurality of elongated wing plates in the front portion beneath the seat each having a bore and a pin passed through the bores for withstanding a force applied by the curve member.

11. The infant support of claim 6, wherein the curve member comprises a bend, a top portion, a footrest, and a plurality of apertures, the curve member being in the first position when the curve member is extended away from the seat with the elongated wing plates snapped in the apertures of the curve member passing through the opening, or the second position when the curve member is beneath the seat with the footrest received in the opening and the top portion urged against the underside of the seat.

12. The infant support of claim 6, further comprising a plurality of triangular wing plates centrally disposed under the bottom of the seat, and the curve member further comprises an engagement portion engaged with the edges of the triangular wing plates in the second position.

* * * * *